US006630776B2

(12) United States Patent
Nakayama et al.

(10) Patent No.: US 6,630,776 B2
(45) Date of Patent: Oct. 7, 2003

(54) COLOR CATHODE RAY TUBE

(75) Inventors: Takeshi Nakayama, Fukaya (JP); Shinichiro Nakagawa, Fukaya (JP); Takashi Murai, Fukaya (JP); Masatsugu Inoue, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/025,929

(22) Filed: Dec. 26, 2001

(65) Prior Publication Data

US 2002/0084738 A1 Jul. 4, 2002

(30) Foreign Application Priority Data

Dec. 28, 2000 (JP) ..... 2000-402315

(51) Int. Cl.[7] ..... H01J 29/80
(52) U.S. Cl. ..... 313/407; 313/402; 313/404
(58) Field of Search ..... 313/407, 402, 313/405, 403, 404

(56) References Cited

U.S. PATENT DOCUMENTS 3,808,493 A * 4/1974 Kawamura et al. ..... 313/404
6,051,918 A * 4/2000 Hayashi et al. ..... 313/407
6,384,522 B1 * 5/2002 Tani et al. ..... 313/402
6,559,585 B2 * 4/2003 Murai et al. ..... 313/402

* cited by examiner

*Primary Examiner*—Sandra O'Shea
*Assistant Examiner*—Peter Macchiarolo
(74) *Attorney, Agent, or Firm*—Oblon, Spivak, McClelland, Maier & Neustadt, P.C.

(57) ABSTRACT

A shadow mask includes a substantially rectangular effective region formed having a number of electron beam passage apertures and opposed to a phosphor screen and a substantially rectangular skirt portion provided around the effective region and extending in the direction of a tube axis. The skirt portion has a pair of long sides extending substantially parallel to a major axis and a pair of short sides extending substantially parallel to a minor axis, the long and short sides being welded to the inner surface of a substantially rectangular mask frame. A distance a from an extending end of the skirt portion on each long side to the weld spot is longer than a distance b from an extending end of the skirt portion on each short side to the weld spot.

6 Claims, 3 Drawing Sheets

COLOR CATHODE RAY TUBE

CROSS-REFERENCE TO RELATED APPLICATIONS

This application is based upon and claims the benefit of priority from the prior Japanese Patent Application No. 2000-402315, filed Dec. 28, 2000, the entire contents of which are incorporated herein by reference.

BACKGROUND OF THE INVENTION

1. Field of the Invention

The present invention relates to a color cathode ray tube provided with a shadow mask.

2. Description of the Related Art

In general, color cathode ray tubes that are used in color TV sets and the like comprise an envelope, which includes a substantially rectangular face panel and a funnel. The face panel has an effective portion formed of a curved surface and a skirt portion on the peripheral part of the effective portion. The funnel is bonded to the skirt portion. Formed on the inner surface of the effective portion of the face panel is a phosphor screen that is formed of three-color phosphor layers and black non-luminous layers.

Inside the face panel, a shadow mask is opposed to the phosphor screen. The shadow mask is a substantially rectangular structure that has an effective portion, which is formed having a large number of electron beam passage apertures, and a skirt portion that is formed by bending the peripheral part of the effective portion. The skirt portion, which has no electron beam passage apertures, extends substantially at right angles to the effective portion and forms a sidewall. The shadow mask is located inside a substantially rectangular mask frame in a manner such that its skirt portion is fixed to the mask frame.

An electron gun that emits three electron beams is located in a neck of the funnel. In the color cathode ray tube, the three electron beams emitted from the electron gun are deflected by means of a magnetic field that is generated by a deflection yoke on the outside of the funnel. As the phosphor screen is scanned horizontally and vertically with the aid of the shadow mask, a color image is displayed on the screen.

In the color cathode ray tube constructed in this manner, the shadow mask is one of the essential members that has a color sorting function. In order to display an image without a color drift on the phosphor screen, the electron beam passage apertures of the shadow mask and the phosphor layers corresponding thereto must be kept in specific relative positions to ensure accurate beam landing. This positional relation must be kept constant during the operation of the cathode ray tube. More specifically, the distance (q-value) between the shadow mask and the phosphor layers must always be within a fixed tolerance.

During the operation of the color cathode ray tube of the shadow-mask type, on the other hand, only ⅓ or less of all the electron beams that are emitted from the electron gun can pass through the electron beam passage apertures of the shadow mask and reach the phosphor screen. The remaining electron beams run against the effective portion of the shadow mask and, as thermal energy, heat the shadow mask. In consequence, the shadow mask undergoes thermal expansion and causes a doming phenomenon such that it bulges on the phosphor-screen side. If the doming phenomenon causes the space (q-value) between the phosphor screen and the shadow mask to exceed the tolerance, beam landing on the phosphor layers is dislocated, and the color purity falls.

Accordingly, an Invar material that has a low coefficient of thermal expansion is frequently used for the shadow mask. On the other hand, a cold-rolled steel sheet, which is relatively low-priced, is used for the mask frame. If the shadow mask and the mask frame are heated during the operation of the color cathode ray tube, in this case, the shadow mask that is firmly welded to the mask frame is pulled by the mask frame, owing to the difference in thermal expansion between the two members.

While the color cathode ray tube is being manufactured, it undergoes heating processes at high temperature, such as a process for forming the phosphor screen, an exhaust process, and the like. Thus, a more serious tensile deformation is caused by the difference in thermal expansion between the shadow mask and the mask frame.

To lessen this effect, many consumer color cathode ray tubes are constructed so that the shadow mask is fixed to the inner peripheral side of the mask frame, as mentioned before. If the mask frame pulls the skirt portion on account of the difference in thermal expansion, in this case, that part of the skirt portion (corresponding to the substantial skirt length) which ranges from weld spots between the skirt portion and the mask frame to the upper side of the skirt portion is deformed diagonally inward. Thus, the skirt portion serves as a cushion to prevent the tensile deformation from influencing the curved surface of the effective portion of the shadow mask.

If the major and minor axes of the shadow mask become longer, as in modern large-screen color cathode ray tubes, however, the difference in elongation that is attributable to the difference in thermal expansion inevitably becomes greater. Since the tensile force that is produced by the thermal expansion of the mask frame increases in proportion to this, more serious problems are caused.

In a color cathode ray tube with a flat screen, moreover, the shadow mask is flattened to match the face panel, so that its curved surface retention strength is lower than that of a conventional shadow mask with a greater curvature. Accordingly, in this case, there is a high possibility of only a small tensile stress causing a substantial deformation of the curved surface. Thus, the tensile stress that acts on the shadow mask is expected to be minimized.

In order to restrain the tensile deformation of the shadow mask that is attributable to the difference in thermal expansion, it is desirable that the skirt portion of the shadow mask should be as deformable as possible. Thus, the tension restraining effect can be improved by maximizing the substantial skirt length. If the substantial skirt length is greater, however, then the skirt portion will more easily undergo deformation in a direction in parallel to its planes. In other words, the greater substantial skirt length implies that the shadow mask is liable to be deformed in directions perpendicular to the tube axis in the mask frame.

If the shadow mask is subjected to impact or vibration in a direction perpendicular to the tube axis, therefore, it is easily dislocated in the same direction. If this dislocation occurs, the electron beam passage apertures are dislocated to cause mis-landing such that the electron beams fail to reach the specified phosphor layers, thereby lowering the color purity. As the attachment and detachment of the shadow mask are repeated several times in a phosphor screen forming process, moreover, the shadow mask is inevitably caused to move horizontally or vertically from its set position by impact from the mask frame itself or the like. This dislocation makes it impossible to form a phosphor screen accurately, and possibly results in a serious failure. Recently, in particular, there has been an increasing demand for higher image quality levels, and the pitches of phosphor screens have been narrowed to improve their resolution. Thus, the allowance for beam landing errors is so low that more accurate beam landing is required.

BRIEF SUMMARY OF THE INVENTION

The present invention has been contrived in consideration of these circumstances, and its object is to provide a color cathode ray tube in which dislocation of a shadow mask attributable to thermal expansion can be restrained so that the production stability and image quality level are improved.

A color cathode ray tube according to an aspect of the invention comprises: an envelope including a substantially rectangular face panel, a funnel connected to the face panel, and a neck connected to the funnel; a phosphor screen formed on an inner surface of the face panel; an electron gun located in the neck and configured to emit electron beams toward the phosphor screen; a substantially rectangular shadow mask located opposite to the phosphor screen in the envelope and having a given coefficient of thermal expansion; and a substantially rectangular mask frame having a coefficient of thermal expansion different from that of the shadow mask and supporting the peripheral edge portion of the shadow mask. The face panel, shadow mask, and mask frame have a major axis extending at right angles to a tube axis and a minor axis extending at right angles to the tube axis and the major axis. The shadow mask includes a substantially rectangular effective region formed having a number of electron beam passage apertures and opposed to the phosphor screen, and a substantially rectangular skirt portion provided around the effective region and extending in the direction of the tube axis. The skirt portion has a pair of long sides extending substantially parallel to the major axis and a pair of short sides extending substantially parallel to the minor axis, the long and short sides being welded to the inner surface of the mask frame. A distance a from an extending end of the skirt portion on each long side to a weld spot is longer than a distance b from an extending end of the skirt portion on each short side to a weld spot.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A color cathode ray tube according to an embodiment of the present invention will now be described in detail with reference to the accompanying drawings.

Figure 1:
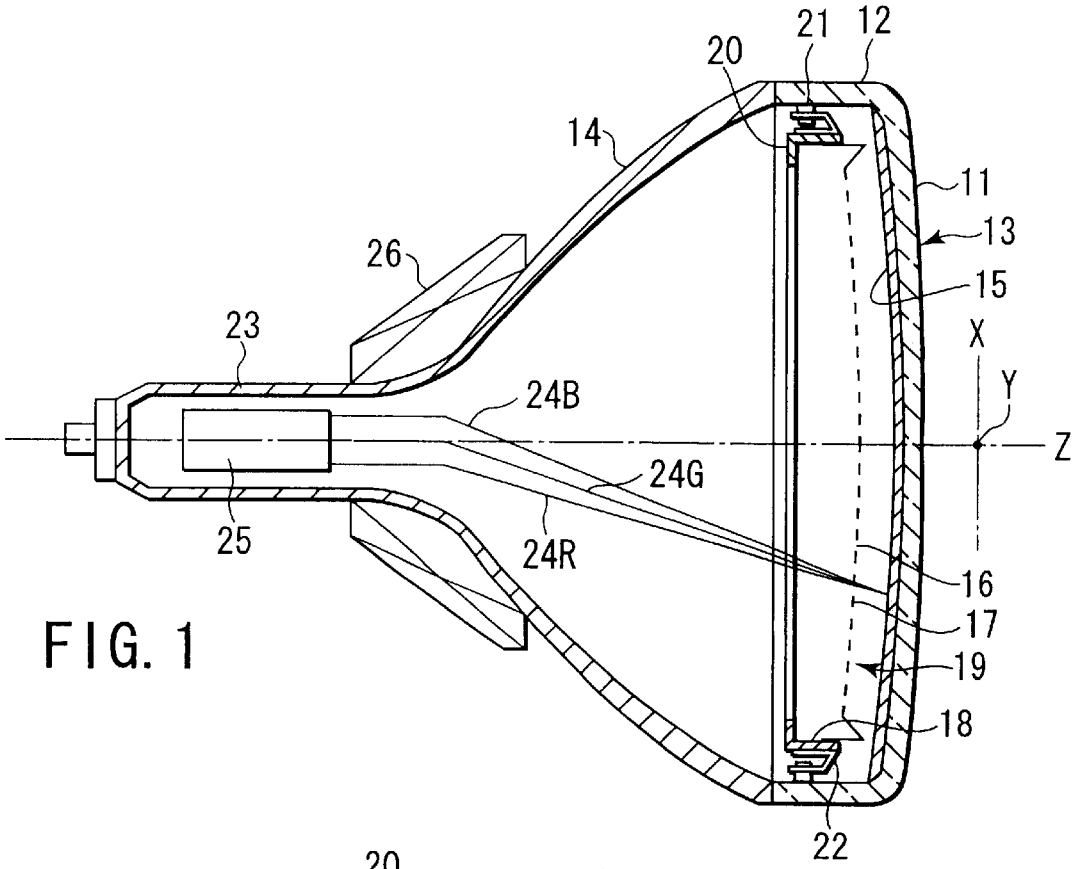
FIG. 1 is a sectional view showing a color cathode ray tube according to an embodiment of the invention.

As shown in FIG. 1, the color cathode ray tube comprises a vacuum envelope of glass, which includes a substantially rectangular face panel 13 and a funnel 14. The face panel 13 has a substantially rectangular effective portion 11 with a curved surface and a skirt portion 12 on the peripheral part of the effective portion. The funnel 14 is bonded to the skirt portion. The effective portion 11 forms a concave surface that is curved with nonsphericality. A phosphor screen 15 is formed on the inner surface of the effective portion 11. It has stripe-shaped three-color phosphor layers, which are arranged regularly and glow blue, green, and red, individually, and black non-luminous layers situated between the phosphor layers.

The effective portion 11 of the face panel 13 and a shadow mask (mentioned later) have a major axis X that extends at right angles to a tube axis Z and a minor axis Y that extend at right angles to the tube axis and the major axis.

Inside the face panel 13, a substantially rectangular shadow mask 19 is opposed to the phosphor screen 15. The shadow mask 19 has a substantially rectangular effective region 17, which is formed having a number of electron beam passage apertures 16, and a skirt portion 18 that is formed by bending the peripheral part of the effective region. The skirt portion 18, which has no electron beam passage apertures, extends substantially at right angles to the effective region 17 and substantially parallel to the tube axis Z.

The shadow mask 19 is located inside a substantially rectangular mask frame 20, and the skirt portion 18 is welded to the inner surface of the mask frame. The shadow mask 19 is elastically supported on the face panel 13 in a manner such that elastic supports 22 fixed individually on the respective outer surfaces of the corner portions of the mask frame 20 are engaged individually to stud pins 21 that are set up on the skirt portion 12 of the face panel 13.

An electron gun 25 that emits three electron beams 24B, 24G and 24R is located in a neck 23 of the funnel 14. In the color cathode ray tube, the three electron beams 24B, 24G and 24R emitted from the electron gun 25 are deflected by means of a magnetic field that is generated by a deflection yoke 26 on the outside of the funnel 14. As the phosphor screen 15 is scanned horizontally and vertically with the aid of the shadow mask 19, a color image is displayed on the screen 15.

Figure 2:
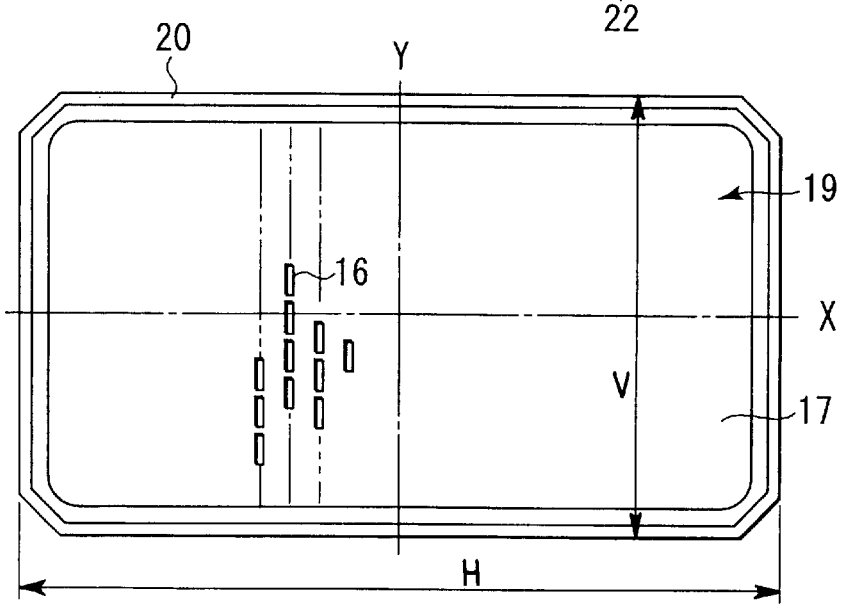
FIG. 2 is a front view showing a shadow mask and a mask frame of the color cathode ray tube.
Figure 3:
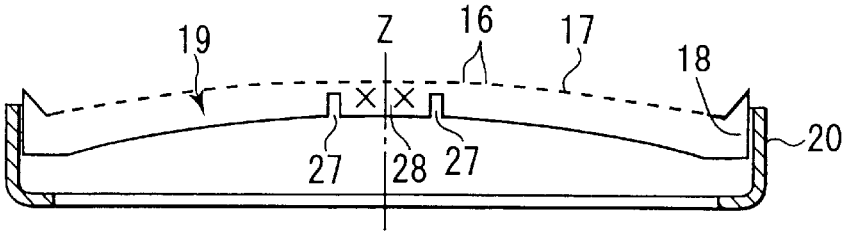
FIG. 3 is a sectional view showing the shadow mask and the mask frame.
Figure 4:
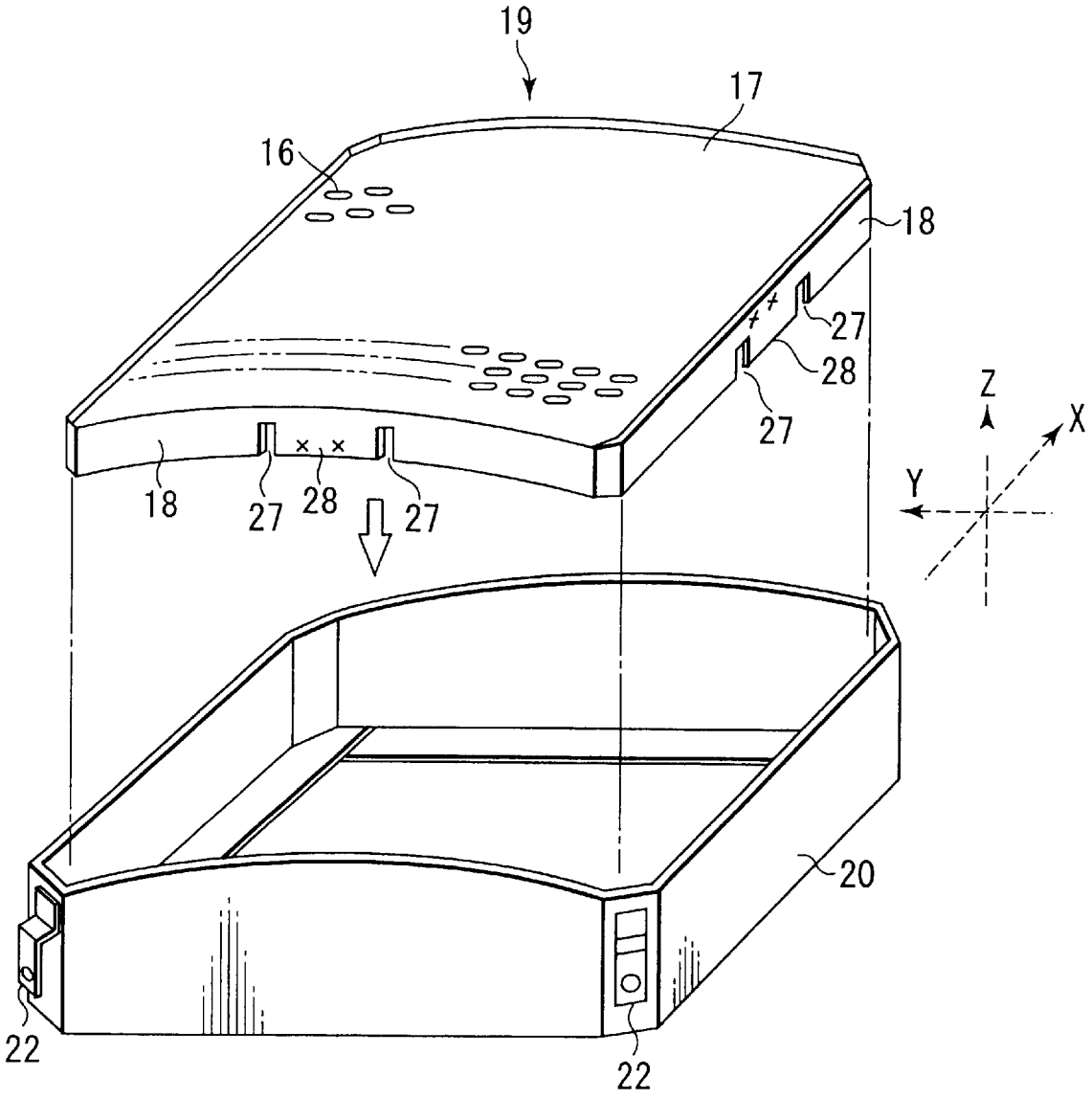
FIG. 4 is an exploded perspective view showing the shadow mask and the mask frame.

As shown in FIGS. 2 to 4, the shadow mask 19 is formed by press-forming an Invar material with a thickness of, for example, about 0.1 mm to 0.3 mm. The effective region 17 of the shadow mask 19 is shaped corresponding to the inner surface of the effective portion 11 of the face panel 13. The effective region 17 is formed having the electron beam passage apertures 16, each of which is in the form of a slit or slot that extends long in the direction of the minor axis Y. The stripe-shaped phosphor layers of the phosphor screen 15, like the electron beam passage apertures 16, extend in the direction of the minor axis Y.

The skirt portion 18 of the shadow mask 19 is provided covering the whole circumference of the effective region 17. Its height or width in the direction of the tube axis Z is fixed throughout the circumference.

Two slits 27 are formed in the intermediate portion of each of long and short side portions of the skirt portion 18. They extend substantially parallel to the tube axis Z, directed from the extending end edge of the skirt portion toward the effective region 17. A tongue portion 28 is defined between each pair of slits 27.

The mask frame 20 is formed by punching a cold-rolled steel sheet with a thickness of about 0.5 mm to 1.5 mm. The Invar material that is used for the shadow mask 19 has a coefficient of thermal expansion lower than that of the cold-rolled steel sheet.

The shadow mask 19 is attached to the inside of the rectangular mask frame 20, and is fixed to the mask frame 20 in a manner such that each of the four tongue portions 28 is spot-welded to the mask frame 20 at one or more weld spots, for example, two, indicated by crosses in the drawings.

Figure 5:
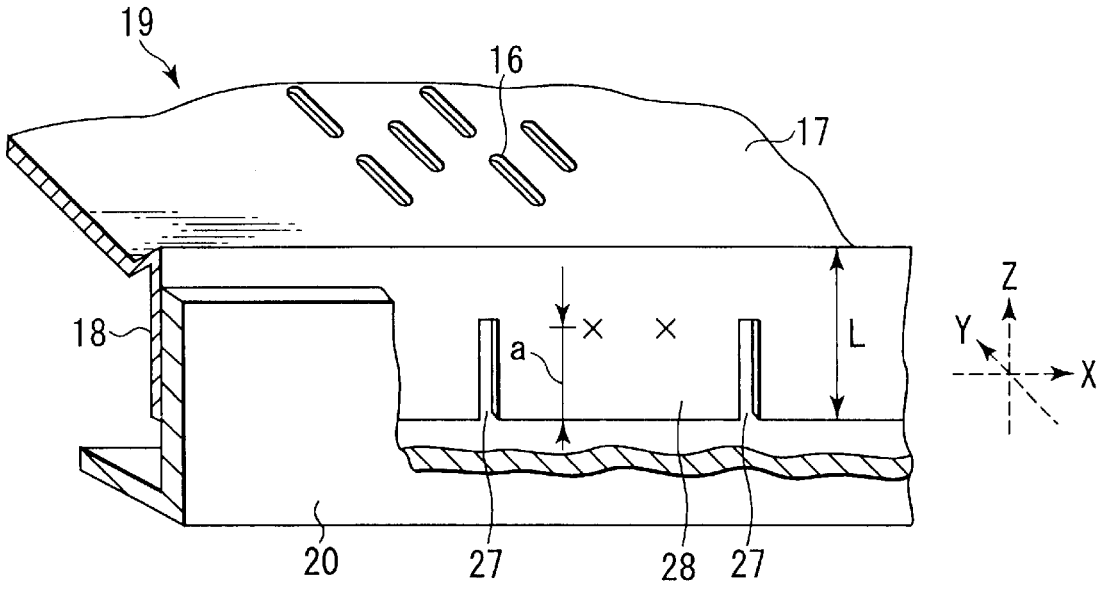
FIG. 5 is a cutaway sectional view showing weld points on the respective long sides of the shadow mask and the mask frame.

As shown in FIGS. 4 and 5, each of the weld spots between the mask frame 20 and the tongue portion 28 in the intermediate portion of each long side of the skirt portion 18 that extends parallel to the major axis X, that is, each tongue portion at each of the ends opposite in the direction of the minor axis Y, is situated at a distance a from the extending end edge of the skirt portion 18, on the side nearer to the effective region 17.

Figure 6:
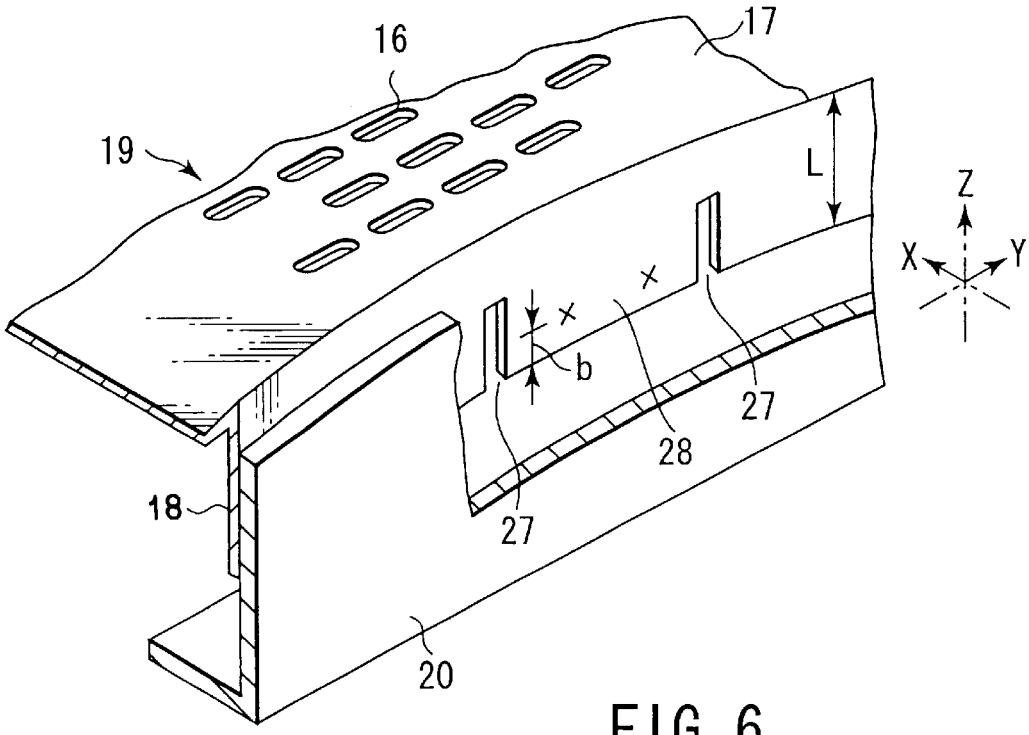
FIG. 6 is a cutaway sectional view showing weld points on the respective short sides of the shadow mask and the mask frame.

As shown in FIGS. 4 and 6, each of the weld spots between the mask frame 20 and the tongue portion 28 in the intermediate portion of each short side of the skirt portion 18 that extends parallel to the minor axis Y, that is, each tongue portion at each of the ends opposite in the direction of the major axis X, is situated at a distance b from the extending end edge of the skirt portion 18, on the side nearer to the effective region 17.

The distances a and b are set so that they have the relationship a>b. Preferably, they are set as follows:

$$(L-a)/(L-b) \leqq (V/H),$$

where L is the width of the skirt portion 18 in the direction of the tube axis Z, V is the length of the mask frame 20 in the direction of the minor axis Y, and H is the length of the mask frame 20 in the direction of the major axis X.

If the shadow mask 19 is heated so that the mask frame 20 is brought to high temperature during operation or manufacturing processes, in the color cathode ray tube constructed in this manner, the frame 20, which has a coefficient of thermal expansion higher than that of the mask 19, extends longer owing to the difference in thermal expansion. Accordingly, the mask frame 20 pulls the shadow mask 19 outward. The resulting tensile elongations in the directions of the major and minor axes X and Y are different on account of the difference in length between the axes. More specifically, the tensile elongation at the major-axis end of the mask frame 20 is greater than the elongation at the minor-axis end by a margin corresponding to the difference in length between the axes.

As the mask frame 20 pulls the shadow mask 19, the skirt portion 18 of the mask 19 that includes the tongue portions 28 are elastically deformed to spread outward, thereby absorbing the difference in thermal expansion between the mask frame and the shadow mask, that is, a tensile force that acts on the effective region 17. In this case, the distance b from the each weld spot of the tongue portion 28 at each major-axis end to the extending end edge of the skirt portion 18 and the distance a from each weld spot of the tongue portion 28 at each minor-axis end to the extending end edge of the skirt portion 18 are set so that they have the relationship a>b. At the same time, the width L of the skirt portion 18 is uniform throughout the circumference. Therefore, those tongue portions 28 and those parts of the skirt portion 18 on the major-axis end side can bend more easily than the ones on the minor-axis end side. Accordingly, the absorption of the tensile force by the deflection of the skirt portion 18 is greater in the direction of the major axis X of the shadow mask 19 than in the direction of the minor axis Y. Thus, the influence of the tensile force on the curved surface of the shadow mask 19 is greater in the direction of the minor axis Y. Since each electron beam passage aperture 16 in the shadow mask 19 has the shape of a rectangular slit that extends long in the direction of the minor axis Y, however, the shadow mask is more resistant against deformation in the minor-axis direction than in the direction of the major axis X. Thus, the curved surface of the mask can be kept in a given state.

On the other hand, against deformation of the shadow mask 19 in a direction in parallel to the skirt portion 18, it is preferable that the distance from the fixing point, i.e., the weld spot, between the shadow mask 19 and the mask frame 20 to the extending end edge of the skirt portion 18 is long. Thus, when the distance a from the each weld spot between the long side of the mask frame 20 and the shadow mask 19 to the extending end edge of the skirt portion 18 is longer than the distance b from each weld spot between the short side of the mask frame 19 and the shadow mask to the extending end edge of the skirt portion 18, deformation of the shadow mask in a direction in parallel to the long side of the skirt portion 18, i.e., in the direction of the major axis X is a little.

On other words, the shadow mask 19 is difficult to shift in the major axis direction with respect to the mask frame 20. In a color cathode ray tube of the stripe-type wherein the shadow mask is provided with slits extending in a direction in parallel to the minor axis of the shadow mask, since the phosphor layers of the phosphor screen continuously extend in the direction of the minor axis, they have a considerable allowance for a beam landing error in the minor-axis direction. On the other hand, a beam landing error in the direction of the major axis may directly lead to lowering of color purity, in some cases. According to the present embodiment, since the shadow mask 19 can lessen dislocation in the direction of the major axis X, however, the beam landing error in the major-axis direction can be reduced to improve the yield of production and the image quality level.

In order to absorb the difference between the coefficients of thermal expansion in the directions of the major and minor axes X and Y of the shadow mask 19, the substantial length of the skirt portion 18 may possibly be changed by altering the width of the skirt portion itself. If the skirt width on each long side is to be differentiated from that on each short side, however, forces that act on the long and short sides fail to be uniform as the shadow mask is pressed, so that the formability worsens. According to the present embodiment, on the other hand, the width of the skirt portion is uniform throughout the circumference, so that the shadow mask can be manufactured with stability.

Further, the skirt portion 18 of the shadow mask 19 has the tongue portions 28 that are defined by the slits 27, and the tongue portions are welded to the mask frame 20. Accordingly, the tensile force that is produced by the thermal expansion of the mask frame 20 can be absorbed mainly by the tongue portions 28 without substantially acting on the whole shadow mask 19. If the weld points are set on the tongue portions 28, therefore, the curvature of the shadow mask 19 can be more steadily kept at a predetermined value.

According to the color cathode ray tube described above, the dislocation of the shadow mask in the mask frame can be minimized in a manner such that deformation of the curved surface of the shadow mask that is attributable to heat generated during operation or manufacturing processes is restrained even though the screen is flat and the curved surface of the mask is not sufficiently strong. The yield of production can be improved by enhancing the stability of production in a phosphor screen forming process, in particular. Even in the case of a color cathode ray tube that has a shadow mask with narrower aperture pitches for high quality levels, moreover, beam landing errors can be lessened effectively to restrain the color purity from falling and to ensure display of higher-quality images.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the skirt portion of the shadow mask may be welded directly to the mask frame without being provided with the slits. In the embodiment described above, the skirt portion of the shadow mask has a uniform width throughout its circumference. However, it is necessary only that the width of the intermediate portion of each side of the skirt portion that is welded to the mask frame be uniform. Alternatively, the width of each long side of the skirt portion may be differentiated from that of each short side. In this case, the same effect as in the foregoing embodiment can be obtained by setting the weld spot positions so that the distance from each weld spot between the major-axis end of the shadow mask and the mask frame to the upper end of the skirt portion is longer than the distance from each weld spot between the minor-axis end of the shadow mask and the mask frame to the upper end of the skirt portion.

What is claimed is:

1. A color cathode ray tube comprising:

an envelope including a substantially rectangular face panel, a funnel connected to the face panel, and a neck connected to the funnel;

a phosphor screen formed on an inner surface of the face panel;

an electron gun located in the neck and configured to emit electron beams toward the phosphor screen;

a substantially rectangular shadow mask located opposite to the phosphor screen in the envelope and having a given coefficient of thermal expansion; and a substantially rectangular mask frame having a coefficient of thermal expansion different from that of the shadow mask and supporting a peripheral edge portion of the shadow mask, the face panel, shadow mask, and mask frame having a major axis extending at right angles to a tube axis and a minor axis extending at right angles to the tube axis and the major axis, the shadow mask including a substantially rectangular effective region formed having a number of electron beam passage apertures and opposed to the phosphor screen, and a substantially rectangular skirt portion provided around the effective region and extending in the direction of the tube axis, the skirt portion having a pair of long sides extending substantially parallel to the major axis and a pair of short sides extending substantially parallel to the minor axis, the long and short sides being welded to the inner surface of the mask frame, a width of the skirt portion in the direction of the tube axis being uniform throughout a circumference of the shadow mask, and a first distance being a distance from an extending end of the skirt portion on each long side to a weld spot, a second distance being a distance from an extending end of the skirt portion on each short side to a weld spot, and the first distance being longer than the second distance.

2. A color cathode ray tube according to claim 1, wherein said first and second distances are set as follows:

$$(L-a)/(L-b) \leqq (V/H),$$

where "a" is the first distance, "b" is the second distance, L is the width of the skirt portion in the direction of the tube axis at each weld spot, V is the length of the mask frame in the direction of the minor axis, and H is the length of the mask frame in the direction of the major axis.

3. A color cathode ray tube according to claim 1, wherein each long side of said skirt portion is welded to the mask frame in a position near the minor axis, and each short side of said skirt portion is welded to the mask frame in a position near the major axis.

4. A color cathode ray tube according to claim 3, wherein each of the long and short sides of said skirt portion has a plurality of slits extending from the extending end of the skirt portion toward the effective region and a tongue portion defined between the slits, and said skirt portion is welded to the mask frame in positions corresponding to the tongue portions.

5. A color cathode ray tube according to claim 1, wherein each of said electron beam passage apertures is formed of a slot having a longitudinal axis extending parallel to the minor axis.

6. A color cathode ray tube comprising:

an envelope including a substantially rectangular face panel, a funnel connected to the face panel, and a neck connected to the funnel;

a phosphor screen formed on an inner surface of the face panel;

an electron gun located in the neck and configured to emit electron beams toward the phosphor screen;

a substantially rectangular shadow mask located opposite to the phosphor screen in the envelope and having a given coefficient of thermal expansion; and a substantially rectangular mask frame having a coefficient of thermal expansion different from that of the shadow mask and supporting a peripheral edge portion of the shadow mask, the face panel, shadow mask, and mask frame having a major axis extending at right angles to a tube axis and a minor axis extending at right angles to the tube axis and the major axis, the shadow mask including a substantially rectangular effective region formed having a number of electron beam passage apertures and opposed to the phosphor screen, and a substantially rectangular skirt portion provided around the effective region and extending in the direction of the tube axis, the skirt portion having a pair of long sides extending substantially parallel to the major axis and a pair of short sides extending substantially parallel to the minor axis, the long and short sides being welded to the inner surface of the mask frame, a first distance being a distance from an extending end of the skirt portion on each long side to a weld spot, a second distance being a distance from an extending end of the skirt portion on each short side to a weld spot, and the first distance being longer than the second distance, and the first and second distances being set as follows:

$$(L-a)/(L-b) \leqq (V/H),$$

where "a" is the first distance, "b" is the second distance, L is the width of the skirt portion in the direction of the tube axis at each weld spot, V is the length of the mask frame in the direction of the major axis, and H is the length of the mask frame in the direction of the major axis.

* * * * *